US012152802B2

(12) United States Patent
Duffy

(10) Patent No.: US 12,152,802 B2
(45) **Date of Patent: *Nov. 26, 2024**

(54) FIRE-RATED VENTILATION DUCT AND IMPROVEMENTS THEREIN

(71) Applicant: Vaughanair Canada ULC, Crofton, MD (US)

(72) Inventor: William Christopher Duffy, Thornhill (CA)

(73) Assignee: VAUGHANAIR CANADA ULC, Crofton, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/743,319

(22) Filed: May 12, 2022

(65) Prior Publication Data

US 2022/0268480 A1 Aug. 25, 2022

Related U.S. Application Data

(63) Continuation of application No. 16/829,782, filed on Mar. 25, 2020, now Pat. No. 11,333,390.

(51) Int. Cl.
*F24F 13/02* (2006.01)

(52) U.S. Cl.
CPC ..... *F24F 13/0263* (2013.01); *F24F 13/0209* (2013.01); *F24F 13/0281* (2013.01); *F24F 2221/30* (2013.01)

(58) Field of Classification Search
CPC ..... F24F 13/0263; F24F 13/0209; F24F 13/0218; F24F 2221/30
See application file for complete search history.

(56) References Cited

U.S. PATENT DOCUMENTS 2,226,523 A 12/1940 Peck
4,940,264 A 7/1990 Mez
(Continued)

FOREIGN PATENT DOCUMENTS

CA 2829645 4/2015
CN 2179516 10/1994
(Continued)

OTHER PUBLICATIONS

International Search Report and Written Opinion for PCT/CA2020/050996 mailed Dec. 9, 2020.
(Continued)

*Primary Examiner* — David R Deal
(74) *Attorney, Agent, or Firm* — Workman Nydegger

(57) ABSTRACT

A fire-rated ventilation duct system and improvements therein. According to an embodiment, the fire-rated ventilation duct section comprises, an inner liner configured as conduit for air movement, the inner liner comprising a metallic material and having a first end and a second end, and the first end including a first connection section, and the second end including a second connection section; an outer casing configured for encasing the inner liner, the outer casing comprising a metallic material having a fire-rating, the outer casing having a first end and a second end, and the first end including a first duct connection section configured for joining one end of a second fire-rated ventilation duct, and the second end including a second duct connection section configured for joining one end of a third fire-rated ventilation duct; an insulation layer configured to provide a thermal insulation layer between the inner liner and the outer casing, and the first connection section of the inner liner further comprising a first liner spacer and the second connection section of the inner liner further comprising a second liner spacer, the first and the second liner spacers being
(Continued)

configured to define a cavity for receiving and positioning said insulation layer between an outer surface of the inner liner and an inner surface of the outer casing; the first duct connection section of the outer casing being configured to attach to at least a portion of the first connection section of the inner liner, and the second duct connection section of the outer casing being configured to attach to at least a portion of the second connection section of the inner liner to form a sealed duct section.

13 Claims, 9 Drawing Sheets

(56) References Cited

U.S. PATENT DOCUMENTS

| | | | |
|---|---|---|---|
| 5,450,879 | A | 9/1995 | Toben |
| 5,653,482 | A | 8/1997 | Ficchi, Jr. |
| 5,673,947 | A | 10/1997 | De Waal |
| 6,213,522 | B1 | 4/2001 | Jacobson et al. |
| 6,412,519 | B1 | 7/2002 | Goodhue |
| 6,561,553 | B1 | 5/2003 | Issaghollan-Havai |
| 6,840,284 | B2 | 1/2005 | Schippl et al. |
| 6,848,720 | B2 | 2/2005 | Carns et al. |
| 7,699,078 | B1 | 4/2010 | Husmann, Jr. |
| 11,333,390 | B2 * | 5/2022 | Duffy ..... F24F 13/0263 |
| 2005/0116470 | A1 | 6/2005 | Duffy |
| 2013/0174934 | A1 | 7/2013 | Duffy |
| 2021/0302058 | A1 | 9/2021 | Duffy |

FOREIGN PATENT DOCUMENTS

| | | |
|---|---|---|
| DE | 102015117190 | 4/2017 |
| DE | 202015009334 | 4/2017 |

OTHER PUBLICATIONS

Office Action for U.S. Appl. No. 16/829,782 mailed Jul. 7, 2021.

Notice of Allowance received for U.S. Appl. No. 16/829,782, mailed on Jan. 12, 2022, 7 pages.

Office Action received for Saudi Arabia Patent Application No. 522432035, mailed on Oct. 4, 2022, 9 pages (2 pages of English Translation and 7 pages of Original Document).

* cited by examiner

SLIP ON "J" PROFILE

SLIP ON "L" PROFILE

ROLL FORMED / BROKEN "J" PROFILE

ROLL FORMED / BROKEN "L" PROFILE

SLIP ON CASING CONNECTOR

ROLL FORMED / BROKEN CASING CONNECTOR

FIRE-RATED VENTILATION DUCT AND IMPROVEMENTS THEREIN

CROSS-REFERENCE TO RELATED APPLICATIONS

The present application is a continuation of U.S. patent application Ser. No. 16/829,782, filed Mar. 25, 2020, the entire content of which is incorporated herein by reference.

FIELD OF THE INVENTION

The present invention relates to duct systems and more particularly, to a fire-rated ventilation duct system.

BACKGROUND OF THE INVENTION

Various regulatory regimes require that buildings be designed and constructed to provide safe means of egress to enable the occupants to safely exit the building in case of fire. Typically, this involves constructing floors and walls in a building which are fire-rated and designed to prevent fire from spreading from one area, compartment, or floor, to another. To ensure the designated egress routes such as stairways are passable, fresh air is supplied to egress routes, so they are maintained under positive pressure, and contaminated air is exhausted from fire compartments. Such an arrangement is designed to prevent the contaminated air from migrating from the engaged fire compartment to the egress routes and/or other sections of the building.

In addition to ventilating the egress routes in a building, new buildings may be designed to utilize the fire rated ventilation ducts for the handling of other types of non-hazardous exhaust that pass through the interior sections and fire separations in the building before being exhausted outdoors. For instance, commercial kitchen dishwasher exhaust and swimming pool exhaust are two examples of exhaust systems that contain high moisture and mildly corrosive elements that benefit from the elimination of required fire dampers, and the associated costs for the inspection and maintenance of the fire dampers, in these types of duct systems.

To protect these ducts so they can continue to function when exposed to fire, building codes typically require a shaft type construction that is configured to enclose the duct and the duct supports. Shaft type construction typically requires multiple layers of gypsum board to be installed to metal framing members. Such installations typically require considerable space around the duct to accommodate the multiple layers of gypsum board. In addition, to the requirements for installation, there are limitations on the maximum span which limits the enclosable duct size, and the resultant fire ratings are typically limited to a 2-hour fire rating when enclosing horizontal ducts.

In the art, there are also known fire-rated wrap systems that utilize ceramic insulation. Such systems typically involve wrapping installed ventilation systems fabricated from sheet metal with one or two layers of ceramic insulation blankets that are enclosed in a foil scrim outer layer. Most systems require the end of each insulation wrap to be overlapped by the next wrap section along the duct's length and sealed with foil backed tape in order to create a seal. Typically, the end of each wrap around the duct typically overlaps the starting end of the wrap so there are no butt seams in the system, with the ends once again sealed with foil backed tape. Stainless steel bands are then wrapped and clamped around the outer insulation layer to hold the insulation in place during a fire.

While the outer foil scrim layer construction can be effective to provide the required fire resistance rating, the foil scrim layer is easily susceptible to physical damage. As a result, local regulatory regimes and/or building codes require that the "wrapped" systems also be encased or enclosed with an outer sheet metal casing to prevent damage to the foil scrim layer to thereby avoid reducing the fire-rating or fire resistance rating of the system.

It will be appreciated that "wrap type" fire-rated duct systems suffer from a number of drawbacks including:

(1) the need for coordination of multiple trades, and possible return visits by some early scheduled trades, to properly install the various components comprising a complete system. This substantially increases the wrap system's installed cost and can also result in project delays.

(2) the inability to ensure all aspects of the system have been correctly installed per the manufacturer's and listing requirements due to the multiple insulation layers required and the additional outer sheet metal enclosure. Improper installation could result in a system offering little or no fire protection.

(3) the increased outer dimension and/or weight of the completed system due to the thickness of the insulation wrap material and the multiple required overlaps at the insulation blanket seams.

(4) the difficulty in installing and supporting the outer sheet metal casing around the insulated duct system due to the multiple overlaps required in the insulation wrap system which gives rise to uneven surfaces that must be enclosed.

In the art, there are also known fire-rated duct systems that utilize rigid fire-resistant insulating boards as cladding to make the duct systems fire resistant. Similar to ceramic insulation wrap systems, the fire-resistant insulating boards are installed after the duct (sheet metal) systems are first installed. Each system and board manufacturer typically have their own specific installation requirements. Typically, the installation of the board systems involves the placement of spacers, cut from the same board material as the outer enclosure, around the duct so that the fire-resistant enclosure boards can clear the duct's traverse duct connectors. Installation of the enclosure boards often involves applying mastic to the edges of abutting boards in order to provide a seal between the boards. This is followed by nailing, stapling or otherwise banding the boards together along their longitudinal edges to prevent them from separating in a fire. Some known systems also require additional boards to be installed over the transverse joints in the system to prevent the passage of heat though those joints.

It will be appreciated that known "board type" fire-rated duct system also suffer from a number of drawbacks including:

(1) the need for multiple trade coordination to install the finished system which similar to the insulation wrap systems can result in project delays (2) the insulating boards are susceptible to damage from physical impact during installation and/or after installation (3) certain types, or brands, of insulating boards are not moisture resistant and therefore need to be replaced overtime, particularly if exposed to water or to high levels of moisture for any extended period of time.

Accordingly, there remains a need for improvements in the art.

BRIEF SUMMARY OF THE INVENTION

The present invention is directed to a fire-rated ventilation duct system and improvements therein.

According to an embodiment, the present invention comprises a fire-rated ventilation duct section comprising: an inner liner configured as conduit for air movement, said inner liner comprising a metallic material and having a first end and a second end, and said first end including a first connection section, and said second end including a second connection section; an outer casing configured for encasing said inner liner, said outer casing comprising a metallic material having a fire-rating, said outer casing having a first end and a second end, and said first end including a first duct connection section configured for joining one end of a second fire-rated ventilation duct, and said second end including a second duct connection section configured for joining one end of a third fire-rated ventilation duct; an insulation layer configured to provide a thermal insulation layer between said inner liner and said outer casing, and said first connection section of said inner liner further comprising a first liner spacer and said second connection section of said inner liner further comprising a second liner spacer, said first and said second liner spacers being configured to define a cavity for receiving and positioning said insulation layer between an outer surface of said inner liner and an inner surface of said outer casing; said first duct connection section of said outer casing being configured to attach to at least a portion of said first connection section of said inner liner, and said second duct connection section of said outer casing being configured to attach to at least a portion of said second connection section of said inner liner to form a sealed duct section.

According to another embodiment, the present invention comprises a fire-rated ventilation duct assembly comprising: a first duct module, said first duct module including, an inner liner configured as conduit for air movement, said inner liner comprising a metallic material and having a first end and a second end, and said first end including a first connection section, and said second end including a second connection section; an outer casing configured for encasing said inner liner, said outer casing comprising a metallic material having a fire-rating, said outer casing having a first end and a second end, and said first end including a first duct connection section and said second end including a second duct connection section, an insulation layer configured to provide a thermal insulation layer between said inner liner and said outer casing, and said first connection section of said inner liner further comprising a first liner spacer and said second connection section of said inner liner further comprising a second liner spacer, said first and said second liner spacers being configured to define a cavity for receiving and positioning said insulation layer between an outer surface of said inner liner and an inner surface of said outer casing; said first duct connection section of said outer casing being configured to attach to at least a portion of said first connection section of said inner liner, and said second duct connection section of said outer casing being configured to attach to at least a portion of said second connection section of said inner liner to form a sealed duct section; and a second duct module, said second duct module including, an inner liner configured as conduit for air movement, said inner liner comprising a metallic material and having a first end and a second end, and said first end including a first connection section, and said second end including a second connection section; an outer casing configured for encasing said inner liner, said outer casing comprising a metallic material having a fire-rating, said outer casing having a first end and a second end, and said first end including a first duct connection section and said second end including a second duct connection section, an insulation layer configured to provide a thermal insulation layer between said inner liner and said outer casing, and said first connection section of said inner liner further comprising a first liner spacer and said second connection section of said inner liner further comprising a second liner spacer, said first and said second liner spacers being configured to define a cavity for receiving and positioning said insulation layer between an outer surface of said inner liner and an inner surface of said outer casing; said first duct connection section of said outer casing being configured to attach to at least a portion of said first connection section of said inner liner, and said second duct connection section of said outer casing being configured to attach to at least a portion of said second connection section of said inner liner to form a sealed duct section; and said second duct connection section of said first duct module being configured for joining the first duct connection section of said second duct module, so that said first duct module and said second duct module are coupled together to form said fire-rated ventilation duct assembly.

According to another embodiment, the present invention comprises a fire-rated duct section comprising: an inner liner configured as conduit for air movement, said inner liner comprising a metallic material and having a first end and a second end, and said first end including a first spacer section, and said second end including a second spacer section; an outer casing configured for encasing said inner liner, said outer casing comprising a metallic material, said outer casing having a first end and a second end, and said first end including a first duct connection section configured for joining one end of a second fire-rated ventilation duct, and said second end including a second duct connection section configured for joining one end of a third fire-rated ventilation duct; an insulation layer configured to provide a thermal insulation layer between said inner liner and said outer casing, and said first and said second spacer sections being configured to define a cavity for receiving and positioning said insulation layer between an outer surface of said inner liner and an inner surface of said outer casing; and said first duct connection section of said outer casing being configured to attach to at least a portion of said first spacer section of said inner liner, and said second duct connection section of said outer casing being configured to attach to at least a portion of said second spacer section of said inner liner to form a sealed duct section.

According to another embodiment, the present invention comprises a fire-rated duct assembly comprising: a first duct module, said first duct module including, an inner liner configured as a conduit for air movement, said inner liner comprising a metallic material having a specified fire-rating, and having a first end and a second end, and said first end including a first connection section, and said second end including a second connection section; an outer casing configured for encasing said inner liner, said outer casing comprising a metallic material having a fire-rating specification, said outer casing having a first end and a second end, and said first end including a first duct connection section and said second end including a second duct connection section, said first duct connection section of said outer casing being configured to attach to at least a portion of said first connection section of said inner liner, and said second duct connection section of said outer casing being configured to attach to at least a portion of said second connection section of said inner liner to form a sealed duct section; said outer casing comprising a first duct connector at said first end, and a second duct connector at said second end, said first duct connector comprising a formed section having a J profile, and said second duct connector comprising a formed section having a J profile; and a second duct module, said second duct module including, an inner liner configured as a conduit for air movement, said inner liner comprising a metallic material having a specified fire-rating, and having a first end and a second end, and said first end including a first connection section, and said second end including a second connection section; an outer casing configured for encasing said inner liner, said outer casing comprising a metallic material having a specified fire-rating, said outer casing having a first end and a second end, and said first end including a first duct connection section and said second end including a second duct connection section, said first duct connection section of said outer casing being configured to attach to at least a portion of said first connection section of said inner liner, and said second duct connection section of said outer casing being configured to attach to at least a portion of said second connection section of said inner liner to form a sealed duct section; said outer casing comprising a first duct connector at said first end, and a second duct connector at said second end, said first duct connector comprising a formed section having a J profile, and said second duct connector comprising a formed section having a J profile; and said first duct connector of said first duct module being configured for coupling to said second duct connector of said second duct module, so that said first duct module and said second duct module are connected together to form said fire-rated ventilation duct assembly.

Other aspects and features of the present invention will become apparent to those ordinarily skilled in the art upon review of the following description of embodiments of the invention in conjunction with the accompanying figures.

BRIEF DESCRIPTION OF THE DRAWINGS

Reference will now be made to the accompanying drawings which show, by way of example, embodiments of the present invention, and in which.

Like reference numerals indicate like or corresponding elements or components in the drawings.

DETAILED DESCRIPTION OF THE EMBODIMENTS OF THE INVENTION

Figure 1:
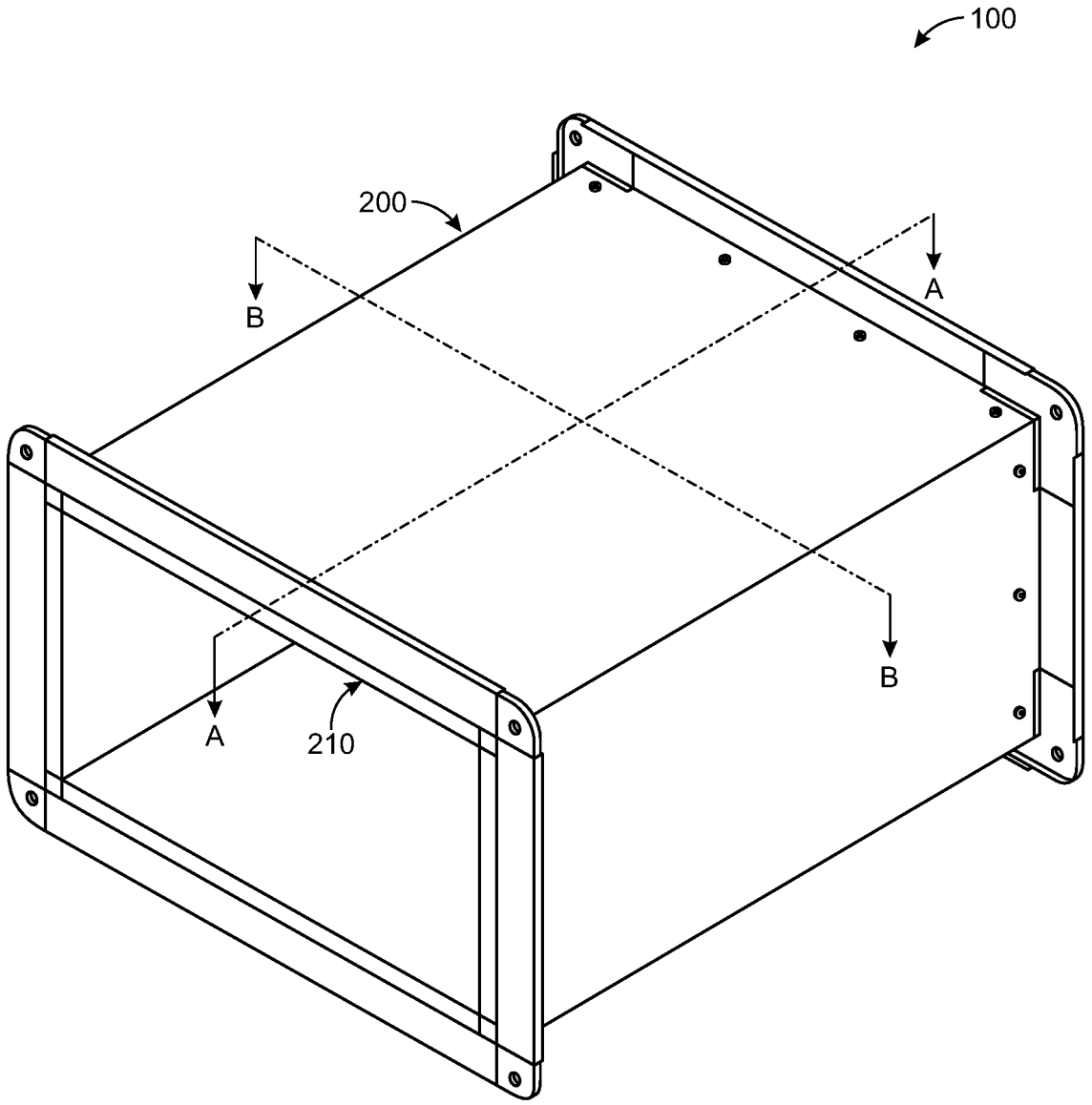
FIG. 1 shows in diagrammatic form a fire-rated duct system comprising a straight rectangular duct section according to an embodiment of the present invention.

Reference is made to FIG. 1, which shows in diagrammatic form a fire-rated ventilation duct system according to an embodiment of the present invention. The fire-rated ventilation duct system comprises a rectangular duct section or module indicated generally by reference 100. A duct system is formed by adjoining or connecting together rectangular duct sections or modules 100, for example, as indicated by reference 800 and described in more detail below and with reference to FIG. 8. It is to be appreciated that while the duct sections are described with a rectangular configuration, according to other embodiments, the duct sections may equally comprise square, oval, circular and other cross-sectional configurations.

Figure 2:
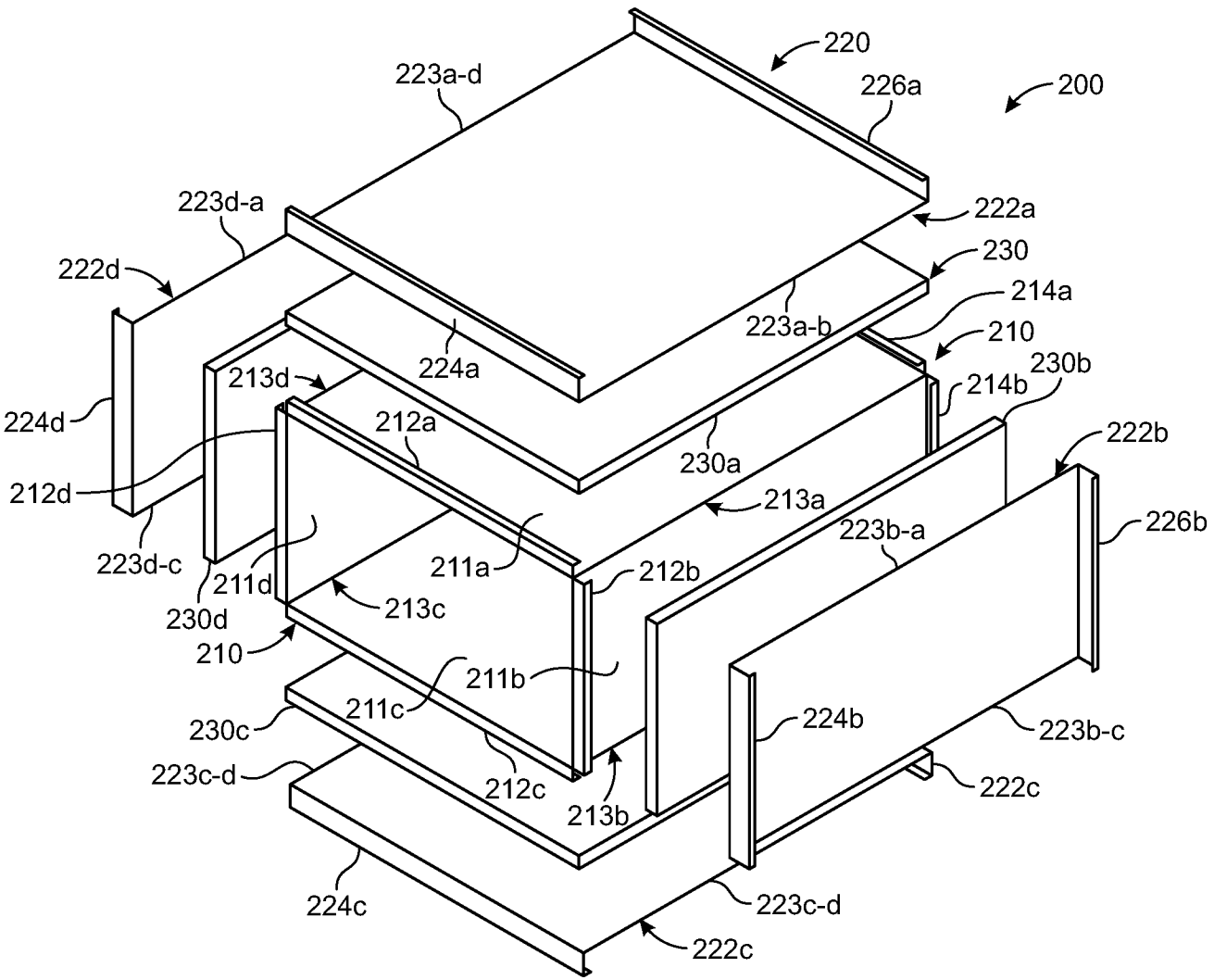
FIG. 2 shows an exploded view of the rectangular duct section of FIG. 1.

Reference is made to FIG. 2, which shows an exploded or expanded view of the rectangular duct section 100 of FIG. 1, as indicated generally by reference 200. According to an embodiment, the rectangular duct section 200 comprises an inner duct or inner duct liner indicated by reference 210, and an outer casing indicated generally by reference 220. According to an exemplary implementation, the inner duct liner 210 comprises a plurality of panels or sections 211, for example, four panels as indicated individually by references 211*a*, 211*b*, 211*c* and 211*d* as shown in FIG. 2, and also described in more detail below. According to an exemplary implementation, the outer casing 220 comprises a plurality of panels or sections 222, for example, four panels as indicated individually by references 222*a*, 222*b*, 222*c* and 222*d* as shown in FIG. 2, and also described in more detail below. As also shown in FIG. 2, the duct section 200 comprises an insulating layer indicated generally by reference 230. According to an exemplary implementation, the insulating layer 230 comprises panels formed from a non-combustible insulating material and indicated individually by references 230*a*, 230*b*, 230*c* and 230*d* in FIG. 2.

According to an exemplary embodiment, the inner duct 210 is fabricated from a metal or metallic sheet, such as, galvanized steel, aluminized steel, stainless steel, or aluminum, or other types of sheet metals, as required by the ventilation system's intended application. The inner duct or duct liner 210 may be formed or fabricated with a number of cross-sectional shapes or profiles, for instance, square, rectangular, circular or oval. According to an exemplary implementation, the inner duct liner sections or tubes 210 can be formed from flat metal sheets or from continuous metal coils. In typical installations and applications, rectangular shaped or oval shaped tubes are generally utilized as they are easier to fit into the crowded or confined ceiling spaces typical in the buildings being constructed today.

The wall thickness of the inner duct liner 210 will vary and/or be dependent on the metal used to fabricate the inner liner, the specific metal type, the dimensions of the ducts and/or duct spans, and/or operating pressure of the duct system. In accordance with industry practice, the metal thickness should, at a minimum, meet the requirements of applicable industry standards or regulations, such as for example, the ASHRAE or SMACNA HVAC standards.

According to an exemplary implementation, the inner duct liner 210 may be fabricated in square, rectangular, circular or oval configurations in a similar manner according to a process comprising the following steps or operations:

- forming one piece of flat metal into a tube of the desired shape;
- forming two or more pieces of flat metal into "L" shaped sections and joining their longitudinal edges to form a square or a rectangular tube;
- forming one piece of flat metal into a "U" shape then capping the "U" with a separate flat piece forming a square or rectangular tube;
- forming two pieces of flat metal into "U" shapes, with square or curved corners, then joining them to form a square, rectangular, or oval tube;
- utilizing four or more separate flat pieces, forming them if required, and then joining them to form a tube; or,
- utilizing a continuous strip of metal from a coil that is spirally wound on a machine to form a continuous round tube that then forms into the desired duct cross section, typically an oval section though squares and rectangles sections are possible.

Figure 3:
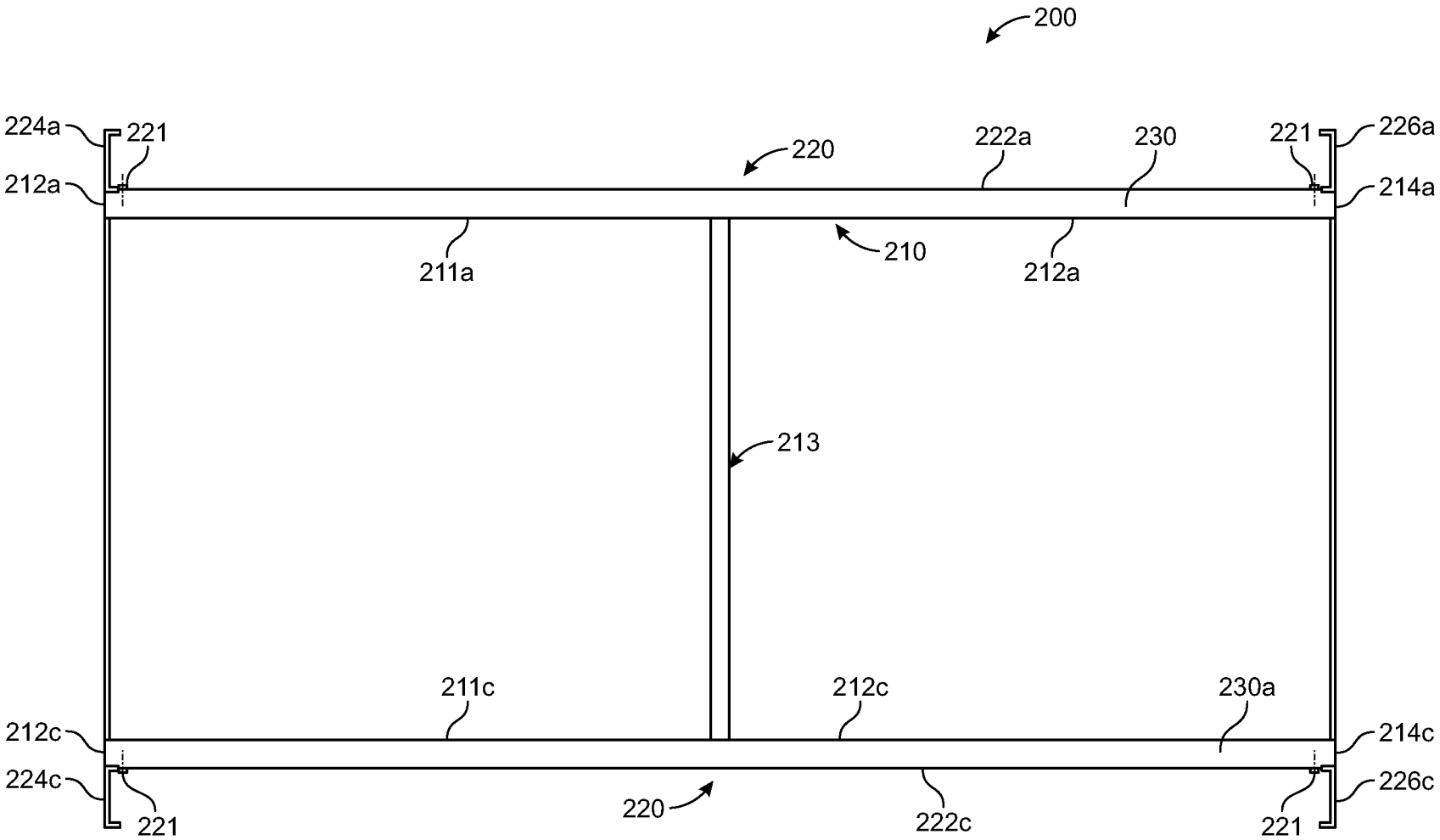
FIG. 3 shows a longitudinal sectional view of the rectangular duct section of FIG. 1 taken along the line A-A.

As shown in FIG. 2, the inner duct liner 210 includes at one end, liner spacer sections 212, indicated individually by references 212*a*, 212*b*, 212*c* and 212*d*, and liner spacer sections 214, indicated individually by references 214*a*, 214*b*, 214*c* and 214*d*, at the other end of the inner liner 210. The liner spacer sections 212, 214 are configured to provide a mechanism for connecting or attaching the inner duct liner 210 to the outer casing 220 comprising the outer casing panels 222, as depicted in FIG. 3 for example. The liner spacer sections 212, 214 are also configured to provide a mechanism for sealing the joint between adjacent duct sections 100 together to form a sealed fire-rated duct assembly, for example, depicted and indicated by reference 800 in FIG. 8, as described in more detail below. As will also be described in more detail below, a rigid connection is formed between the inner duct liner 210 and the outer casing 220, which further provides structural integrity for maintaining the seal of each fire-rated duct section 100 and an assembled system comprising multiple fire-rated duct sections 100 joined together.

As shown in FIG. 2, the outer casing 220 includes at one end connectors connector sections 224, i.e. "outer casing connector sections 224", indicated individually by references 224*a*, 224*b*, 224*c* and 224*d*, and at the other end includes connectors or connector sections 226, i.e. "outer casing connector sections 226", indicated individually by references 226*a*, 226*b*, 226*c* (and 226*d*). The outer casing connector sections 224, 226 are configured to provide a mechanism for connecting or attaching the outer casing 220 to the inner duct liner 210, as depicted in FIG. 3 for example. The outer casing connectors 224, 226 are also configured to provide a mechanism for connecting or attaching adjacent duct sections 100 together to form a sealed fire-rated duct assembly, for example, depicted and indicated by reference 800 in FIG. 8, as described in more detail below.

According to another aspect and as shown in FIGS. 2 and 3, the liner spacer sections 212 are configured to create a channel or space with the outer casing panels 222 for receiving and mounting the non-combustible material (e.g. a board or layer) 230. As also shown in FIG. 3, the duct liner section 100 may include an optional internal support or reinforcement post or member as indicated by reference 213. The support post or member 213 provides additional structural rigidity to the duct section 100, for instance, to prevent deflection of the inner duct liner 210, particularly in large duct installations or application.

Reference is next made to FIGS. 4A to 4D, which shows embodiments of liner spacer sections for attaching the inner duct liner 210 to the outer casing 220 according to the present invention.

Figure 4C:
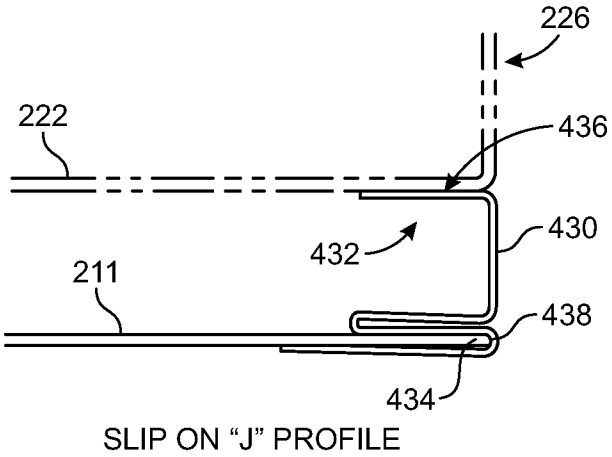
FIG. 4C shows an inner liner spacer comprising a slip on "J" profile according to an embodiment of the present invention.
Figure 4D:
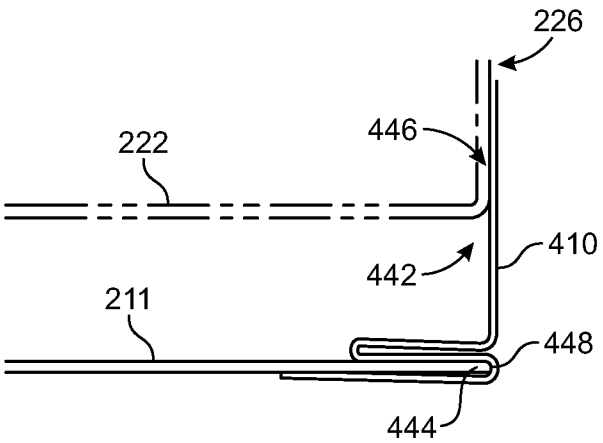
FIG. 4D shows an inner liner spacer comprising a slip on "L" profile according to an embodiment of the present invention.
Figure 4A:
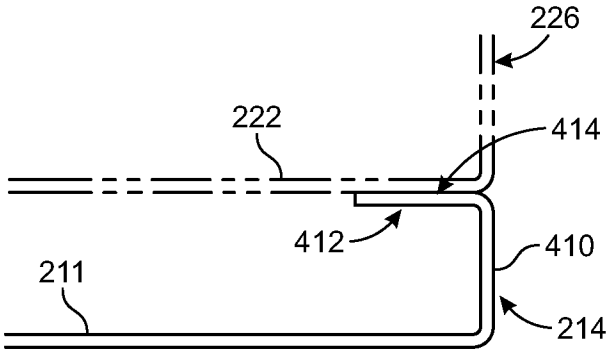
FIG. 4A shows an inner liner spacer comprising a roll formed/broken "J" profile according to an embodiment of the present invention.

As shown in FIG. 4A and according to one embodiment, the liner spacer section comprises a liner spacer section with a broken J profile 410, which is formed on each transverse edge of the inner duct liner panel or section 211. The broken "J" profile is indicated generally by reference 412. The liner spacer sections are configured to provide an attachment point to the outer casing, to function as a spacer between the inner duct liner 210 and the outer casing 220 (for the insulating layer), and/or providing a sealing surface for joining or coupling duct sections together, as described in more detail below. According to an exemplary implementation, the liner spacer section 410 is roll formed from sheet metal as an integral component or element at each end of the inner duct liner 210. As shown, the liner spacer section 410 includes a mounting or attachment surface indicated by reference 414. The mounting surface 414 provides an attachment point or surface for affixing or otherwise attaching the liner spacer section 410 to an adjacent surface on the connector section 226 of the outer casing 220, as shown in FIG. 2. The inner liner duct 210 is attached or connected to the outer casing 220 utilizing mechanical fasteners, for example, as shown in FIG. 3 and indicated by reference 221. Other fastening techniques may be used as will be understood by those skilled in the art.

Figure 4B:
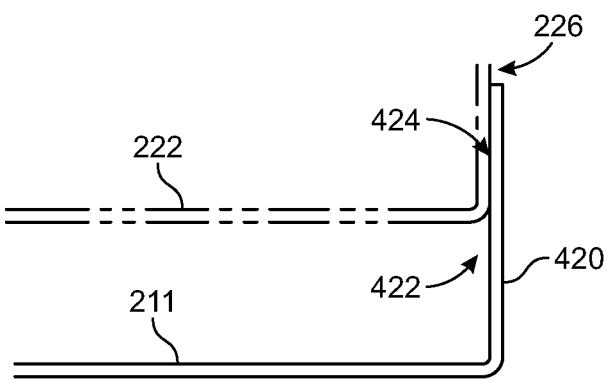
FIG. 4B shows an inner liner spacer comprising a roll formed/broken "L" profile according to an embodiment of the present invention.

Reference is next made to FIG. 4B which shows a liner spacer section with a broken "L" profile according to another embodiment of the present invention, and indicated by reference 420. The broken "L" profile is indicated generally by reference 422. According to an exemplary implementation, the liner spacer section 420 is roll formed from sheet metal as an integral component or element at each transverse end or edge of the inner duct panels 211 in the inner duct liner 210. As shown, the liner spacer section 420 includes a mounting or attachment surface indicated by reference 424. The mounting surface 424 provides an attachment point or surface for affixing or otherwise attaching the liner spacer section 420 to an adjacent surface on the connector section 226 of the outer casing 220, for example, using mechanical fasteners as described above for FIG. 3.

Reference is made to FIG. 4C which shows a liner spacer section comprising a slip-on member or component with "J" profile according to another embodiment of the present invention, and indicated by reference 430. The broken "J" profile is indicated generally by reference 432. According to an exemplary implementation, the slip-on liner spacer section 430 is formed from sheet metal as a separate component or element which is connected, i.e. slipped on/over the transverse end or edge 434 of the inner duct panels 211 in the inner duct liner 210. The slip-on liner spacer section 430 is formed with an attachment surface indicated by reference 436 to fasten or otherwise secure the outer casing panel 226 to the liner spacer section 430 and the inner duct liner 210. As shown in FIG. 4C, the slip-on liner space section 430 may also include a pocket or cavity 438 for receiving an adhesive or sealant which is applied to further secure and/or seal the slip-on liner spacer section 430 to the edge and/or surface of the inner duct panel 211.

Reference is made to FIG. 4D which shows a liner spacer section comprising a slip-on member or component with "L" profile according to another embodiment of the present invention, and indicated by reference 440. The broken "L" profile is indicated generally by reference 442. According to an exemplary implementation, the slip-on "L" profile liner spacer section 440 is formed from sheet metal as a separate component or element which is connected, i.e. slipped on/over the transverse end or edge 444 of the inner duct panels 211 in the inner duct liner 210. The slip-on liner spacer section 440 is formed with an attachment surface indicated by reference 446 to fasten or otherwise secure the outer casing panel 226 to the liner spacer section 440 and the inner duct liner 210. As shown in FIG. 4D, the slip-on liner space section 440 may also include a pocket or cavity 448 for receiving an adhesive or sealant which is applied to further secure and/or seal the slip-on liner spacer section 440 to the edge and/or surface of the inner duct panel 211.

It will be appreciated that the sealant pockets 438 (and 448) provide an effective mechanism to seal the slip-on liner spacer sections 430 to the inner duct panels 211 and provide a sealed or airtight inner duct liner 210.

According to another aspect, the slip-on liner spacer sections 430, 440 to provide the capability to 'field modify' duct sections or modules 100. For instance, the inner duct liner 210 can be cut in the field, the slip-on liner spacer sections 430 reinstalled and the inner duct liner 210 connected to the outer casing 220. According to another aspect, the slip-on liner spacer sections can be configured to act as corner fillers to cover the portion of insulation that is exposed and provide a duct connection sealing surface where the insulation would be exposed at the corners of square and rectangular profile ducts, i.e. between the inner duct liner 210 and the outer casing 220.

It will be appreciated that the liner spacer sections 410, 420 formed as an integral component of the transverse edges of the inner duct panel 211 increases the structural integrity, i.e. stiffness, of the inner duct liner 210. However, for circular or oval duct profiles, the slip-on liner spacer sections 430, 440 may be preferred due to additional considerations for forming raised profiles on curved liner sections, as will be apparent to those skilled in the art.

Figure 6:
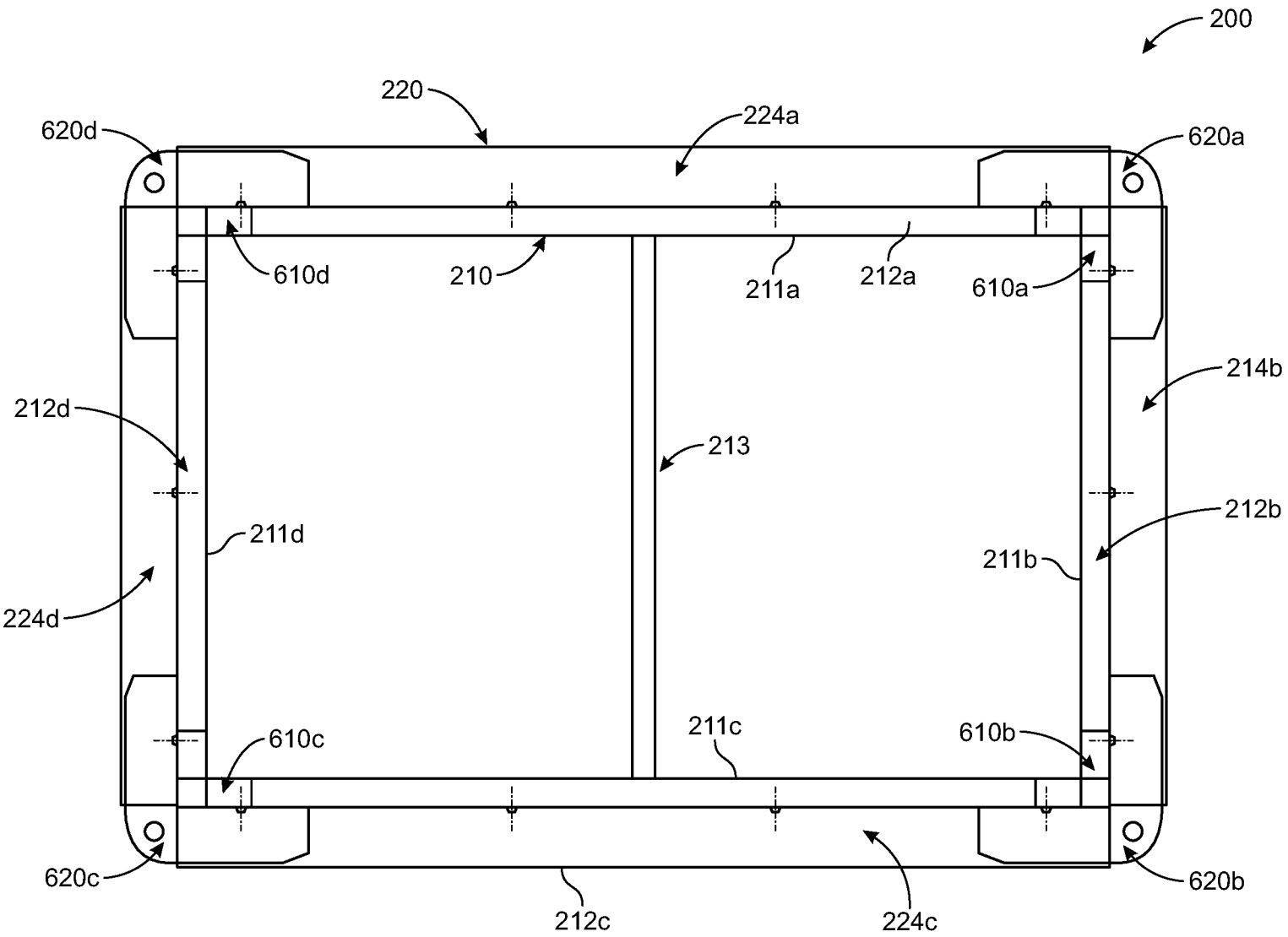
FIG. 6 shows a cross-sectional view of the rectangular duct section of FIG. 1 taken along the line B-B.
Figure 8:
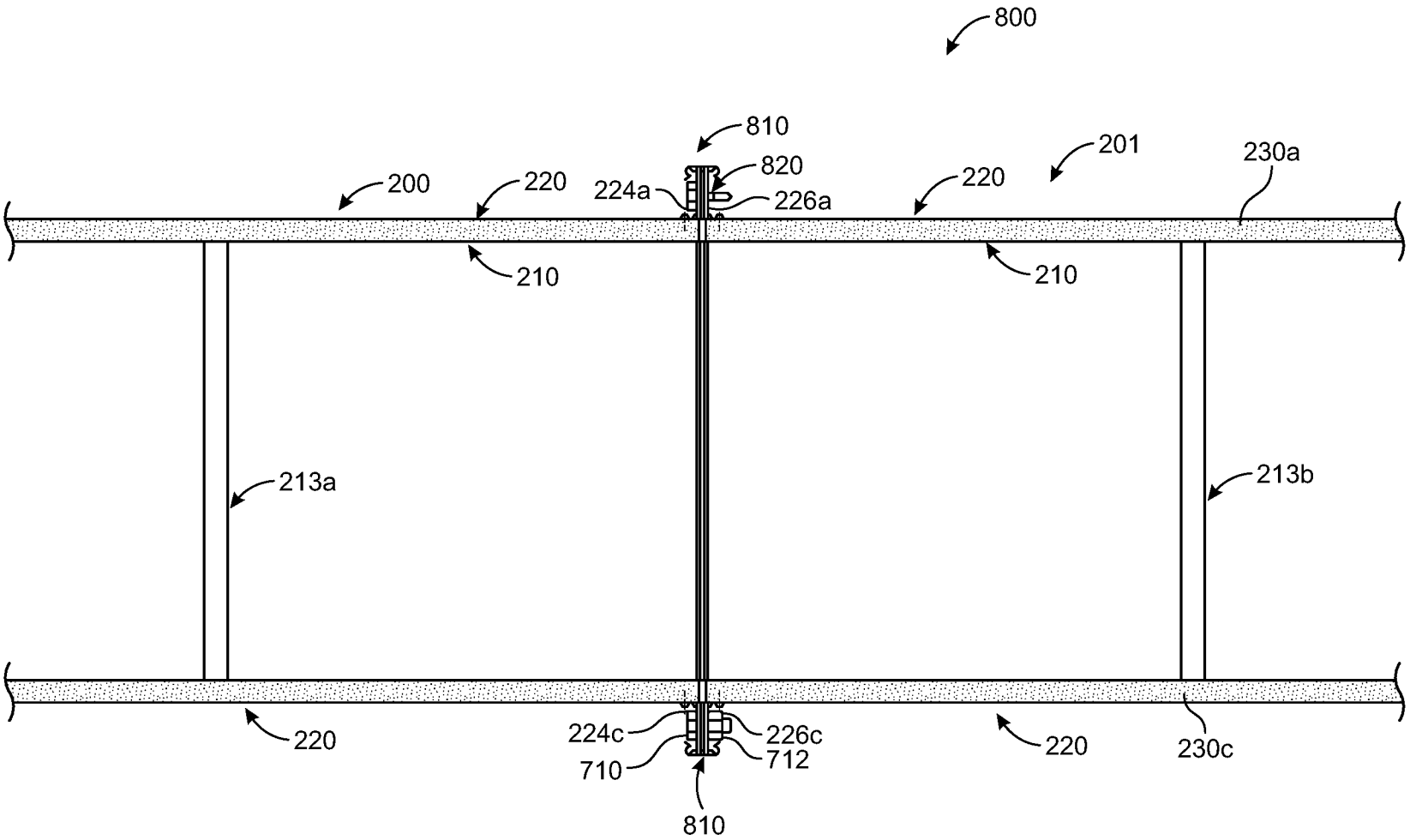
FIG. 8 shows a longitudinal sectional view of the rectangular duct sections of FIG. 7 assembled together and taken along the line C-C.

According to another aspect and as shown in FIG. 6, the liner spacer sections 212, 214 are formed as a continuous member or section along the respective transverse edges of the inner duct liner panel 211. This configuration provides increased stiffness (as describe above) and in addition provides a near continuous sealing surface for connecting adjacent duct sections or modules 100 together to form a fire-rated duct assembly 800 as shown in FIG. 8.

According to another aspect, the liner spacer sections 212, 214 may be formed or fabricated with partially segmented and/or perforated configuration. The partially segmented and/or perforated liner spacers may be fabricated by removing or modifying some or all of the liner spacer's profile at required locations by notching, punching, drilling, slitting, or utilizing other metal fabrication techniques, as will be understood by those skilled in the art. Advantageously, partially segmented and/or perforated liner spacer sections provide weight savings while still maintaining the structural stiffness for the inner duct liner 210 and attachment points or surfaces for the connecting to the outer casing 220. In addition, the liner spacer sections 212, 214 having partially segmented and/or perforated provide a less-effective thermal bridge between the inner duct liner 210 and the outer casing 220 thereby reducing the amount of heat transferred between the inner duct liner 210 and the outer casing 220.

The inner duct liner 210 (FIG. 2) is formed by joining the respective longitudinal edges 213, indicated individually by references 213*a*, 213*b*, 213*c* and 213*d* in FIG. 2, of the inner duct panel(s) 212 together to form a single inner duct liner or conduit 210. According to an exemplary implementation, a mechanical mating joint or lock is formed on the opposing longitudinal edges of the inner duct panel(s) 212 or strip that are to be joined together. Instead of, or in addition to, mechanical locks, welding techniques, e.g. continuous longitudinal weld seams or spirally wound weld seams, may be utilized to fabricate the inner duct liner 210. Such fabrication techniques are suitable for automated and/or largescale fabrication.

For mechanical joint fabrication, the longitudinal joint between adjacent panels or sheets 211 may comprise snap, acme, or Pittsburgh type mechanical lock for inner duct liners 210 comprising 16 ga or lighter metal. If a snap type mechanical lock is used, which is typically limited to 20 ga metal, the assembled joint may require reinforcement with the use of rivets, screws, tack welding, dimpling, or other mechanical fastening methods to lock the components of the male-female joint together to prevent the male leg of the joint from lifting out of the female pocket due to system design pressure or other loads on the inner duct liner 210.

For inner duct liners comprising 16 ga or heavier metals, welded longitudinal seams or spirally wound seams may be preferable over mechanical joint or lock mechanisms due to practical limitations of forming or rolling the heavier gauge metallic sheets. As will be understood by those skilled in the art, suitable welding techniques include continuous welded seams, lapped resistance welded seams, or stitch welding lap seams with sealing between the stitch welds. For heavier or thicker gauge panels, other mechanical joints, such as pocket locks or mechanically fastened laps seams, or welded joints may be utilized.

According to another embodiment, the inner duct liner 210 includes one or more internal stiffeners indicated generally by reference 213 as shown in FIGS. 3 and 6. The internal stiffeners 213 may comprise a hollow rod or post and are attached or installed between opposing inner duct liner panels, for example, at a midway point between the inner duct liner panels 211*a* and 211*c* as shown in FIGS. 3 and 6. The internal stiffeners 213 are configured to resist positive and/or negative loads, and can be standardized over a range of inner duct liners 210. By including the internal stiffeners lighter gauge metallic sheets or materials may be used for the inner duct liner 210. Duct standards, such as SMACNA and ASHRAE HVAC, provide guidance of selection of gauge for inner duct liner panels 211 and also guidance on the minimum acceptable size and spacing requirements for the internal stiffeners. For applications comprising higher pressures and/or wider or longer duct sections, additional internal stiffeners 213 along the width of the inner duct liner 210, and/or along the longitudinal span of the duct assembly may be utilized, for example, as shown in FIG. 8 and indicated by references 213*a*, 213*b*. According to another aspect, the internal stiffener(s) 213 are only connected or attached to the inner duct liner 210 in order to avoid creating a thermal bridge allowing heat to transfer directly between the inner duct liner 210 and the outer casing 220.

According to an exemplary implementation, the insulation layers, e.g. non-combustible boards, blanket or batts, 230 are installed, e.g. attached or affixed, to the respective sides of the inner duct panels 211, as depicted in FIG. 2 and also shown in more detail in FIG. 6. According to another exemplary implementation, the insulation layers 230 are attached or affixed to the inside surfaces of the outer casing panels 222 as shown in FIG. 2.

For an inner duct liner 210 having with a curved surface, e.g. a circular or oval cross-section, the insulation layer 230 will typically comprise a blanket or batt type insulation in order to facilitate attachment or installation to the outer surface(s) of the inner duct liner 210. According to another implementation, the insulation layer 230 may comprise a non-combustible board which meets the fire resistance requirements or specifications (e.g. thickness and/or fire-resistance rating) and is also flexible or bendable to conform to the curved surface(s) of the inner duct liner 210. According to another aspect, the insulation board(s) can be formed to match the curved profile of the inner duct liner 210 according to the oval or circular profile and attached directly to the outer surface. The non-combustible insulation layer 230 may also be temporarily held in place during the assembly of the inner duct liner 210 and the outer casing 220 with the use of weld or stick pins, adhesives, tapes, or friction fitted between the inner duct liner 210 and the inner liner spacer sections 212.

As described above, the inner duct liner 210 can be fabricated utilizing rolled or brake formed techniques. It will be appreciated that when roll formed mechanical locks are used to connect the pieces or sections of the inner duct liner 210 into a tube, the insulation layer 230 may be exposed at the corners of the inner duct liner 210 and the outer casing 220 due to the notching required to form profiles along each edge of the inner duct liner panel 211. It will be further appreciated that the exposed insulation material makes it difficult to seal the inner duct liner 210 of one duct section module to the inner duct liner 210 of an adjacent duct section module in the field without additional treatment or coverage. According to an exemplary implementation, the exposed insulation edges are factory or field coated with a high modulus mastic that seals the insulation surface and bonds the insulation and seal material to the edges and/or surfaces of the liner spacer sections 212. For lower density insulation layers 230, or for insulation materials without sufficient inherent strength to provide a sealed surface, corner sections 610 (indicated individually by references 610*a*, 610*b*, 610*c* and 610*d* in FIG. 6) are attached to the inside face of the vertical leg of the inner liner spacer sections 212, as shown in FIG. 6. The corner sections 610 can be attached utilizing clinching, spot welding, or tack welding, or bonding, in addition to other techniques as will be understood by those skilled in the art. For non-metallic material(s), the corner sections 610 can be attached using mastic, or other suitable adhesives, for bonding the sections 610 in place, as will also be within the understanding of those skilled in the art.

As described with reference to FIG. 2, the outer casing 220 according to an embodiment comprises outer casing panels 222, indicated individually by references 222*a*, 222*b*, 222*c* and 222*d* for a 4-side configuration, fabricated from galvanized steel, or other high temperature sheet metal, for instance, aluminized sheet metal or stainless steel. As described above the outer casing 220 typically has the same cross-sectional shape or profile as the inner duct liner 210. For a rectangular configuration, the outer casing panels 222 are joined or connected along the respective longitudinal edges 223, indicated individually by references, 223*a-b* and 223*b-a*, 223*b-c* and 223*c-b*, 223*c-d* and 223*d-c*, and 223*d-a* and 223*a-d*, in FIG. 2. The inner spacer sections 212 are configured to offset or create a gap or space between the inner duct liner 210 and the outer casing 220, which is substantially equal to, or slightly less, than the thickness of the insulation layer 230 required to achieve the desired or required fire-resistance rating. If the insulation layer 230 utilized comprises a blanket or batt type insulation material, then the insulation layer 230 is slightly compressed once the outer casing 220 is installed in order to prevent the insulation from sagging and possibly gapping at the insulation seams resulting in a reduced fire resistance of the duct assembly.

As described above, the outer casing 220 comprises the outer panels 222 for a rectangular profile or cross-section. The thickness of the metal used to fabricate the outer casing panels 222 will vary by the type of sheet metal used, the size of the duct being fabricated, the operating pressure for the duct system and/or the required fire-resistance rating. At a minimum the metal thickness of the outer casing panels 222 should meet ASHRAE or SMACNA HVAC guidelines.

The outer casing 220 is fabricated in a manner similar to the inner duct liner 210, for instance, as described above. However, the thickness of outer casing panels 222 and/or the connection techniques or mechanisms will vary, for instance, based on the size of the outer casing 220 and/or the difference in size or dimensions between the inner duct liner 210 and the outer casing 220. According to an exemplary implementation, the outer casing 220 may be fabricated in square, rectangular, circular or oval configurations according to a process comprising the following steps or operations:

- forming one piece of flat metal into a tube of the desired shape;
- forming two or more pieces of flat metal into "L" shaped sections and joining their longitudinal edges to form a square or rectangular tube;
- forming one piece of flat metal into a "U" shape then capping the "U" with a separate flat piece forming a square or rectangular tube;
- forming two pieces of flat metal into "U" shapes, with square or curved corners, then joining them to form a square, rectangular, or oval tube;
- using four or more separate flat pieces, forming them if required, and then joining them to form a tube; and
- using a continuous strip of metal that is spirally wound on a machine to form a continuous round tube that is cut to the required length and form into the desired cross-section comprising an oval profile and/or a square or rectangular profile. should meet ASHRAE or SMACNA HVAC guidelines.

The section connectors 224, 226 for the outer casing panels 222 are formed along the opposing transverse ends as shown in FIG. 2. The outer casing section connectors 224, 226 are fabricated utilizing a roll or brake forming process, or as a separate slip-on connector that is attached to the unfinished end or edge of the respective outer casing panel 224 or 226. The outer section connectors 224, 226 are configured to provide a mechanism for joining individual duct sections 200 and 201 together into a continuous conduit at the installation site as shown in FIG. 8 and described in more detail below.

Reference is made to FIG. 5A to 5D, which shows embodiments of outer casing section connectors 224, 226 for the outer casing 220, e.g. the outer casing panels 222, for attaching the inner duct liner 210 to the outer casing 220 according to the present invention.

Figure 5C:
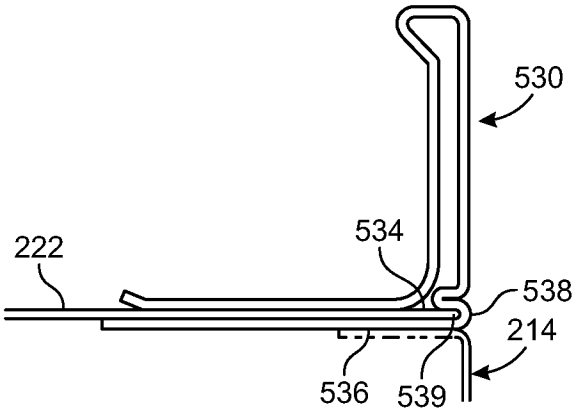
FIG. 5C shows an outer casing connector comprising a slip on casing connector according to an embodiment of the present invention.
Figure 5D:
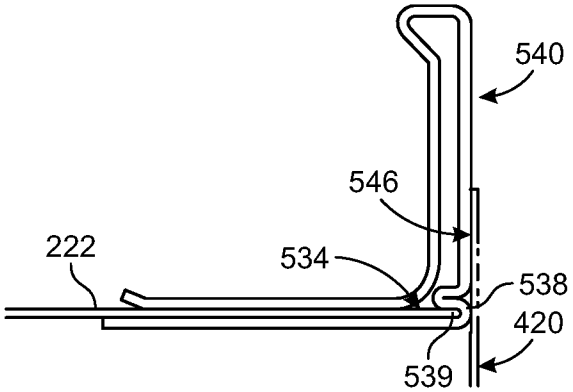
FIG. 5D shows an outer casing connector comprising a slip on casing connector according to another embodiment of the present invention.
Figure 5A:
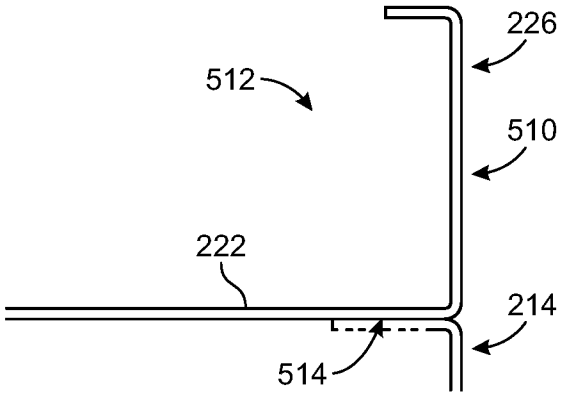
FIG. 5A shows an outer casing connector comprising roll formed/broken casing connector according to an embodiment of the present invention.

As shown in FIG. 5A and according to one embodiment, the outer casing section connector 226 (224) comprises a spacer or a section with a broken J profile 510, which is formed on each transverse edge of the outer casing panel or section 222. The broken "J" profile is indicated generally by reference 512. The outer casing section connectors are configured to provide an attachment point or surface for attaching the liner spacer section 214. According to an exemplary implementation, the outer casing section connector 226 is roll formed from sheet metal as an integral component or element at each end of the outer casing panel 222. As shown, the outer casing section connector 510 includes a mounting or attachment surface indicated by reference 514. The mounting surface 514 provides an attachment point or surface for affixing or otherwise attaching the outer casing section connector 510 to an adjacent surface on the liner spacer section 214 of the inner duct liner 210, as shown in FIG. 2. The inner liner duct 210 is attached or connected to the outer casing 220 utilizing mechanical fasteners, for example, as shown in FIG. 3 and indicated by reference 221. Other fastening techniques may be used as will be understood by those skilled in the art.

According to an exemplary implementation, the outer casing section connector 226 (224) is roll-formed from the sheet metal piece as an integral component at each end of the outer casing panel 222 with the outer edge or leg-end of the J profile having an internal or external return formed on the outer edge. It will be appreciated that this configuration is similar to the connection profiles under SMACNA T-24, T-25a and/or T25b industry standard.

Figure 5B:
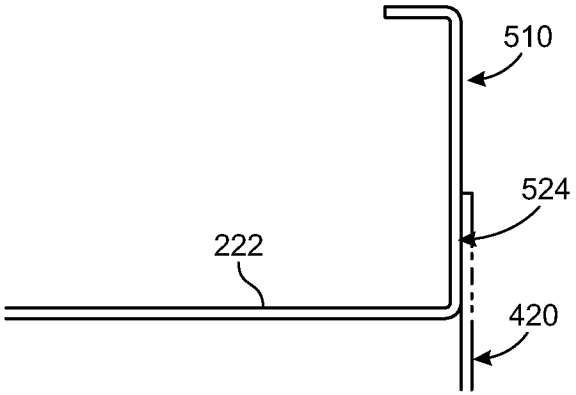
FIG. 5B shows an outer casing connector comprising roll formed/broken casing connector according to another embodiment of the present invention.

Reference is next made to FIG. 5B which shows the outer casing section connector 510 according to another embodiment of the present invention configured with a mounting or attachment surface 524 for affixing or otherwise attaching the liner spacer section 420 to the outer casing 220, for example, using mechanical fasteners as described above for FIG. 3.

Reference is made to FIG. 5C which shows an outer casing section connector comprising a slip-on casing connector according to another embodiment of the present invention, and indicated by reference 530. According to an exemplary implementation, the slip-on outer spacer section 530 is formed from sheet metal as a separate component or element which is connected, i.e. slipped on/over the transverse end or edge 534 of the outer casing panels 222 of the outer casing 220. The slip-on liner spacer section 530 is formed with an attachment surface indicated by reference 536 to fasten or otherwise secure the liner spacer section 214 of the inner duct liner 210. As shown in FIG. 5C, the slip-on casing connector 530 may also include a pocket or cavity 538 for receiving an adhesive which is applied to further secure the slip-on casing connector 530 to the edge and/or surface of the outer casing panel 222.

Reference is made to FIG. 5D which shows the outer casing section connector 540 according to another embodiment of the present invention configured with a mounting or attachment surface 546 for affixing or otherwise attaching the liner spacer section 420 to the outer casing 220, for example, using mechanical fasteners as described above for FIG. 3.

As shown in FIGS. 5C and 5D, the slip-on casing connectors 530 (540) can be formed with sealant pockets 538 according to another embodiment. The sealant pockets 538 are configured to 'grab' the edge of outer casing panel 222. According to another aspect, the sealant pockets 538 can be filled with a sealant indicated by reference 539 to provide a sealed air-tight connection. This alleviates the need to manually seal the perimeter edges of the slip-on casing connectors 530 in order to provide an air-tight duct assembly.

Reference is next made to FIGS. 9A to 9D, which shows embodiments of a reinforced casing section connector (224, 226) for the outer casing 220. The casing section connectors, i.e. duct connectors, are configured to connect adjacent duct modules or sections together to form a duct assembly as described in more detail herein.

Figure 9A:
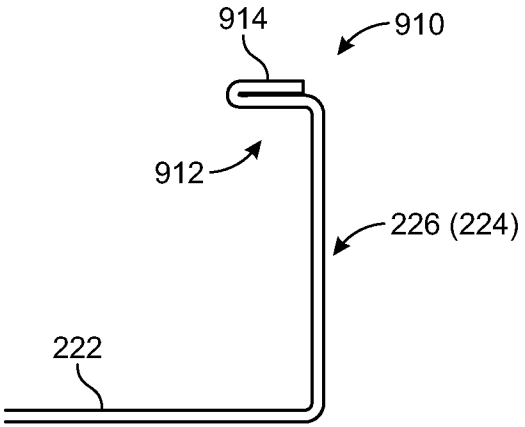
FIG. 9A shows an outer casing connector comprising a reinforced roll formed/broken casing connector according to another embodiment of the present invention.

As shown in FIG. 9A and according to one embodiment, the outer casing section connector 226 (224) comprises a section with a broken J profile 910, which is formed on each transverse edge of the outer casing panel or section 222. The broken "J" profile is indicated generally by reference 912 with an external (e.g. on the external face or surface) reinforcing return or hem formed on the outer most horizontal portion of the "J" profile and indicated by reference 914. According to an exemplary implementation, the outer casing section connector 226 is roll formed from sheet metal as an integral component or element at each end of the outer casing panel 222.

Figure 9B:
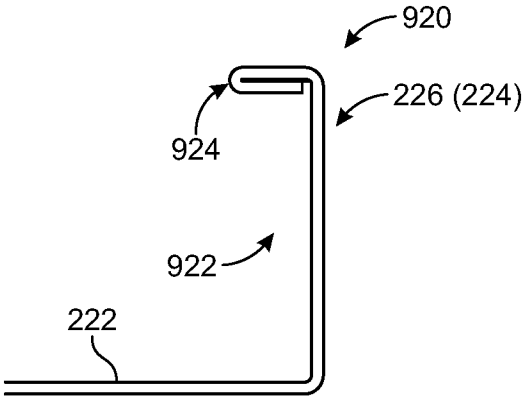
FIG. 9B shows an outer casing connector comprising a reinforced roll formed/broken casing connector according to another embodiment of the present invention.

As shown in FIG. 9B and according to another embodiment, the outer casing section connector 226 (224) comprises a section with a broken J profile 920, which is formed on each transverse edge of the outer casing panel or section 222. The broken "J" profile is indicated generally by reference 922 with an internal (e.g. on the internal face or surface) reinforcing return or hem formed on the outer most horizontal portion of the "J" profile as indicated by reference 924. It will be appreciated that an internal reinforcement is advantageous for the casing section connector as it eliminates the exposed sharp edge of the sheet metal, while also providing the additional reinforcement required. According to an exemplary implementation, the outer casing section connector 226 (224) is roll formed from sheet metal as an integral component or element at each end of the outer casing panel 222.

Figure 9C:
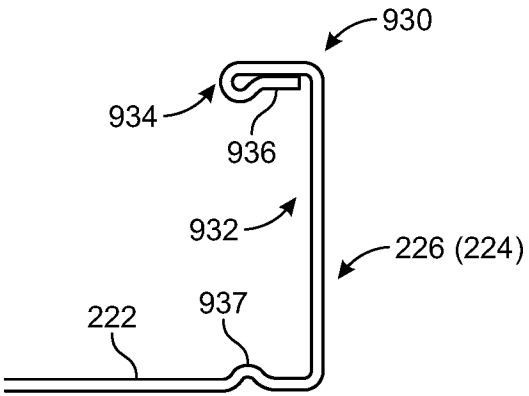
FIG. 9C shows an outer casing connector comprising a reinforced roll formed casing connector according to another embodiment of the present invention.

According to another embodiment and as shown in FIG. 9C, the outer casing section connector 226 (224) comprises a section with an improved roll formed "J" profile indicated by reference 930, which is formed on each transverse edge of the outer casing panel or section 222. The improved "J" profile is indicated generally by reference 932 with an internal reinforcing return or hem formed on the outer most horizontal portion of the "J" profile indicated by reference 934. The internal return 934 is formed to create a recess or groove 936 on the interior face of the most exterior face of the casing connector which is configured to function as a pocket or retention edge, for instance, to locate and maintain the outer edge of the corner connectors (620) tight to the vertical legs of the casing connector. As shown in FIG. 9C, a bead or bulge indicated by reference 937 may also be formed in the outer casing section. The bead 937 is configured to locate and/or maintain the lower edge of the corner connectors (e.g. the corner connectors 620 in FIG. 6) close or tight to the vertical sections or "legs" of the outer casing section connector 224 or 226.

Figure 9D:
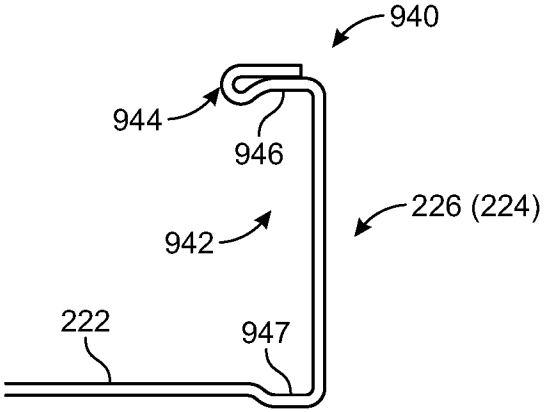
FIG. 9D shows an outer casing connector comprising a reinforced roll formed connector according to another embodiment of the present invention.

As shown in FIG. 9D and according to another embodiment, the outer casing section connector 226 (224) comprises a section with an improved roll formed "J" profile indicated generally by reference 940, which is formed on each transverse edge of the outer casing panel or section 222. The improved "J" profile is indicated generally by reference 942 and comprises an external reinforcing return or hem formed on the outer most horizontal portion of the "J" profile as indicated by reference 944. The external return 944 is formed to create a recess or groove 946 on the interior face of the exterior face of the casing section connector 226. The recess or groove 946 is configured to function as a pocket or retention edge, for instance, to maintain the outer edge of the corner connectors (e.g. the corner connectors 620 in FIG. 6) close or "tight" to the vertical legs of the outer casing section connector. As also shown in FIG. 9D, a groove or recess indicated by reference 948 may be formed in the outer casing section connector 226, adjacent to the vertical section of the outer casing section 226. As shown, the groove or recess protrudes from the outer face of the connector 226 and is configured to locate and/or maintain the lower edge of the corner connectors (e.g. the corner connectors 620 in FIG. 6) close or tight to the vertical sections or "legs" of the outer casing section connector 224 or 226. The outer casing connectors 224, 226 are connected or affixed to the inner duct liner 210 in a manner similar to those described above.

According to another aspect, the slip-on casing connectors 530 provide the capability to 'field modify' a duct section. The field modification may comprise, for instance, cutting the outer casing panels 222 and then re-installing the slip-on connectors 530 and re-attaching the liner spacer connectors 212, 214 to reconnect the inner duct liner 210. According to another aspect the slip-on connectors 530 are configured to provide additional structural rigidity or integrity, and can reduce the need or the number of internal stiffeners, and/or allow for smaller outer liner section connectors 530, 212 or 214, for a given size duct and/or duct operating pressure.

As shown in FIG. 2, the outer casing panels 222 comprise longitudinal edges 223, indicated individually by references 223*a-b*, 223*b-a*, 223*b-c*, 223*c-b*, 223*c-d*, 223*d-c* and 223*d-a*, which are joined or connected together to form the outer casing 210 as an enclosure around the inner duct liner 210. According to an exemplary implementation, the outer casing panels 222 are joined together utilizing a mechanical lock mechanism, such as a mating type joint or lock (e.g. comprising male and female sections or components), which is formed on the opposing longitudinal edges of the outer casing panel 222, as will be understood by those skilled in the art. In addition, to mechanical lock mechanisms, the outer casing panels 222 can be joined or attached together using welding techniques, for instance, longitudinal or spirally wound seams. According to another aspect, the longitudinal joints and mechanical locks can be strengthened by including fasteners connecting the male and female sections of the mechanical lock or by stitch welds along the exterior edges along the length of joint.

Once the outer casing 220 is assembled around the inner duct liner 210 and the insulation boards 230, the section connectors 212, 214 and 224, 226 (or if being utilized, the slip-on connectors are first installed), the section connectors are finished. For a rectangular or a square profile, the section connectors are finished with corner connectors 620, indicated individually by references 620*a*, 620*b*, 620*c* and 620*d*, in FIGS. 6 and 7. The corner connectors 620 are configured to provide additional structural integrity and also keep the cross-section profile of the duct module 200 at least substantially square. According to an exemplary implementation, the corner connectors 620 are configured to snap into place between a groove in the casing face and the return edge of the upper flange of the joint.

To complete the fire-rate duct assembly, the liner spacer connectors 212, 214 are connected to the outer casing section connectors 224, 226. The inner duct liner 210 and the outer casing 220 are aligned on one end to ensure an even sealing surface exists when being installed on site. Once aligned, the outer casing section connectors 224, 226 are attached to the respective liner spacer connectors 212, 214, utilizing screws, rivets, mechanical clinching, or adhesive bonding. For duct sections or modules 100 that will not be modified in the field, the outer casing section connectors 224, 226 and the liner spacer connectors 212, 214 are joined or attached together, as described above.

Figure 7:
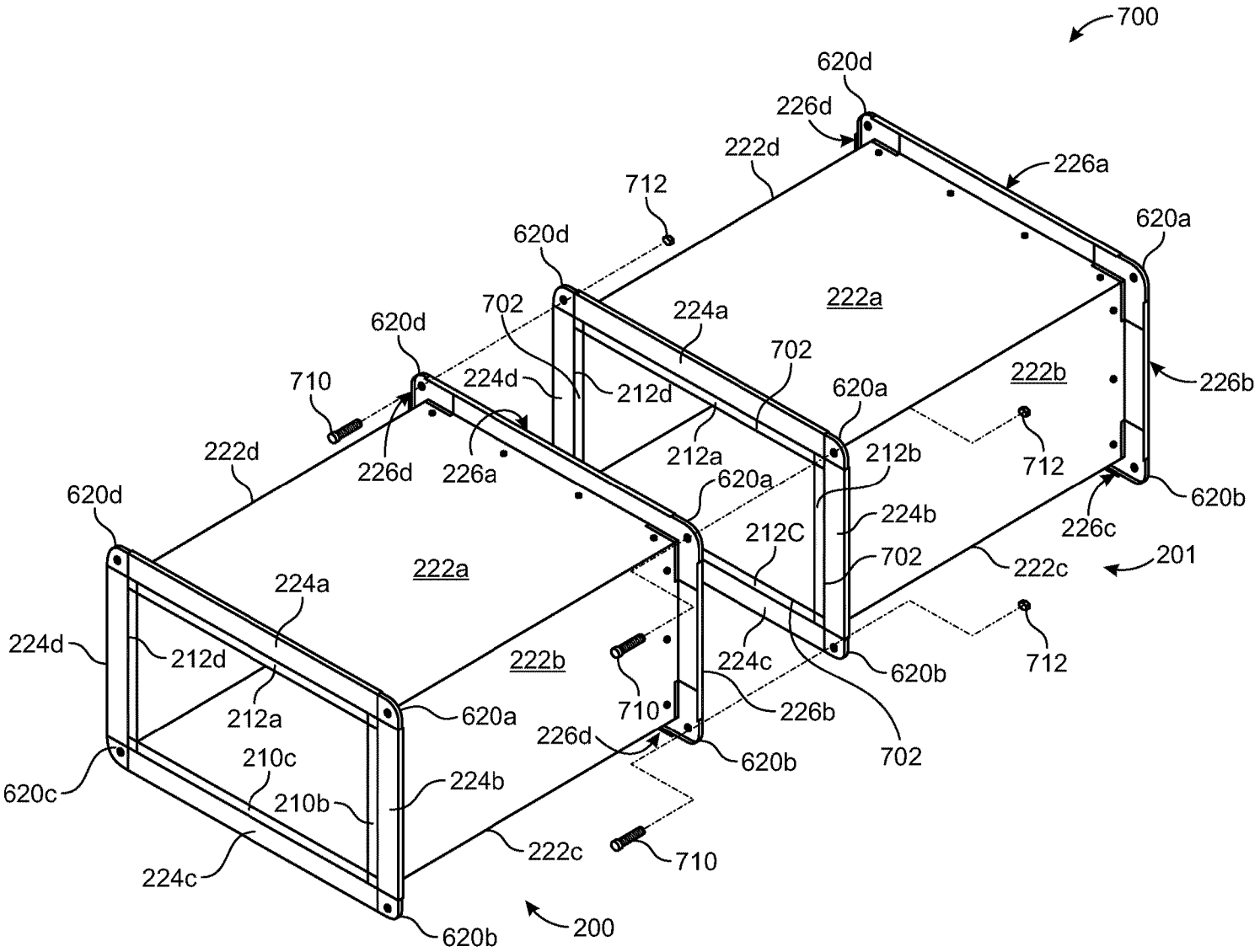
FIG. 7 shows in diagrammatic form a fire-rated duct system comprising first and second adjoining duct sections.

Reference is next made to FIG. 7, which shows a fire-rated duct assembly 700 according to an embodiment of the present invention and comprising a first duct section or module 200 and a second duct section or module 201. As shown in FIG. 7, a fire-resistant sealant or gasket 702 is applied to the face or surface of the liner spacer connectors 212, 214 on the second duct module 201 to further seal to prevent leaks in the duct assembly 700 during normal operation and when exposed to fire. The fire-resistant sealant may comprise either a mastic, or a tape like, gasket, and is applied prior to joining the duct sections 200 and 201 together. The second duct section 201 is positioned towards the first duct section 200 to align the holes in the respective corner connectors 620 on the first 200 and the second 201 duct sections or modules, as shown in FIG. 7. To secure the duct sections 200 and 201 together, a corner bolt 710 is inserted through each corner connector 620 pair and tightened with a nut 712 as shown in FIG. 7 and further in FIG. 8.

To further strengthen (and seal) or prevent the connectors from potentially separating under high heat conditions, the joint or joining surfaces of adjacent duct sections 200 and 201 are strengthened or enhanced with additional retention mechanisms as shown in FIG. 8 and indicated by reference 810. The retention mechanisms indicated by reference 810, indicated individually by references 810*a*, 810*b* (for the top and bottom connection edges of the outer duct sections) comprise a retention clip, for instance, a roll formed retention clip. The roll forming process creates a spring like bias in the clip favouring the clip in a semi-closed or retracted state which snaps over the top edges of the respective section connectors of the adjacent duct sections or modules 200 and 201 (FIGS. 7 and 8). According to an exemplary installation, the retention clips 810 are approximately 6" in length and installed on approximately 12" centers along the span. To further secure the retention clips 810, the clips 810 are crimped tight in at least two locations per clip to ensure the clips 810 locked onto the section connectors of the respective outer casing panels and cannot expand and fall off when exposed to the high temperatures of a fire. The second retention mechanism indicated by reference 820 comprises installing additional fasteners through the section connectors 224, 226, for instance, comprising self-drilling/self-tapping screws 822 screwed through the adjacent section connectors.

For duct sections or modules having a circular or oval profile, the assembly process is modified and comprises the following steps. A fire resistant sealant or gasket is applied to the face of the liner spacer connectors, comprising a sealant as described above. The first and second duct sections are drawn together to align the outer casing connectors. Clamps are attached at the centers of the top and bottom flat sections as well as at the centers of the curved portions of the section connectors to temporarily hold the adjacent duct sections or modules in place. Fasteners, for example, self-drilling/self-tapping screws 822 are installed through the adjacent section connectors, positioned approximately on center and on an approximately 6" to 8" spacing.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

I claim:

1. A fire-rated ventilation duct assembly comprising:

a first duct module, said first duct module including, an inner liner configured as a conduit for air movement, said inner liner comprising a metallic material having a specified fire-rating, and said inner liner having a substantially oval cross-section profile and including a first end and a second end, and said first end including a first connection section, and said second end including a second connection section;

an outer casing configured for encasing said inner liner, said outer casing comprising a metallic material having a fire-rating specification, said outer casing having a substantially oval cross-section profile and including a first end and a second end, and said first end including a first duct connection section and said second end including a second duct connection section, an insulation layer configured to provide a thermal insulation layer between said inner liner and said outer casing, and said first connection section of said inner liner further comprising a first liner spacer and said second connection section of said inner liner further comprising a second liner spacer, said first and said second liner spacers being configured to define a cavity for receiving and positioning said insulation layer between an outer surface of said inner liner and an inner surface of said outer casing;

said first duct connection section of said outer casing being configured to attach to at least a portion of said first connection section of said inner liner, and said second duct connection section of said outer casing being configured to attach to at least a portion of said second connection section of said inner liner to form a sealed duct section; and a second duct module, said second duct module including, an inner liner configured as a conduit for air movement, said inner liner comprising a metallic material having a specified fire-rating, and said inner liner having a substantially oval cross-section profile and including a first end and a second end, and said first end including a first connection section, and said second end including a second connection section;

an outer casing configured for encasing said inner liner, said outer casing comprising a metallic material having a specified fire-rating, said outer casing having a substantially oval cross-section profile and including a first end and a second end, and said first end including a first duct connection section and said second end including a second duct connection section, an insulation layer configured to provide a thermal insulation layer between said inner liner and said outer casing, and said first connection section of said inner liner further comprising a first liner spacer and said second connection section of said inner liner further comprising a second liner spacer, said first and said second liner spacers being configured to define a cavity for receiving and positioning said insulation layer between an outer surface of said inner liner and an inner surface of said outer casing;

said first duct connection section of said outer casing being configured to attach to at least a portion of said first connection section of said inner liner, and said second duct connection section of said outer casing being configured to attach to at least a portion of said second connection section of said inner liner to form a sealed duct section; and said second duct connection section of said first duct module being configured for joining the first duct connection section of said second duct module, so that said first duct module and said second duct module are coupled together to form said fire-rated ventilation duct assembly.

2. The fire-rated ventilation duct assembly as claimed in claim 1, wherein said first connection section and said second connection section for said inner liner comprise a slip-on liner spacer section having a broken J-profile, and each of said slip-on broken J-profile liner spacer sections being configured for coupling and connecting to a respective traverse edge of said inner liner, so that said fire-rated ventilation duct section comprises a field-modifiable configuration.

3. The fire-rated ventilation duct assembly as claimed in claim 1, wherein said first connection section and said second connection section for said inner liner comprise one or more slip-on liner spacer sections, each having a broken L-profile, and each of said slip-on broken L-profile liner spacer sections being configured for coupling and connecting to a respective traverse edge of said inner liner, so that said fire-rated ventilation duct section comprises a field-modifiable configuration.

4. The fire-rated ventilation duct section as claimed in claim 1, wherein said inner liner is formed from a continuous strip of metal spirally wound on a machine to form a continuous tube having one of a round cross-section profile or said oval cross-section profile.

5. The fire-rated ventilation duct section as claimed in claim 1, wherein said inner liner comprises a substantially circular cross-section profile and said outer casing comprises a substantially circular cross-section profile.

6. A fire-rated duct section comprising:

an inner liner configured as a conduit for air movement, said inner liner comprising a metallic material and having a first end and a second end, and said first end including a first spacer section, and said second end including a second spacer section;

said inner liner having substantially circular cross-section profile;

an outer casing configured for encasing said inner liner, said outer casing comprising a metallic material, said outer casing having a first end and a second end, and said first end including a first duct connection section configured for joining one end of a second fire-rated ventilation duct, and said second end including a second duct connection section configured for joining one end of a third fire-rated ventilation duct;

said outer casing having substantially circular cross-section profile;

an insulation layer configured to provide a thermal insulation layer between said inner liner and said outer casing, and said first and said second spacer sections being configured to define a cavity for receiving and positioning said insulation layer between an outer surface of said inner liner and an inner surface of said outer casing;

said first duct connection section of said outer casing being configured to attach to at least a portion of said first spacer section of said inner liner, and said second duct connection section of said outer casing being configured to attach to at least a portion of said second spacer section of said inner liner to form a sealed duct section.

7. The fire-rated duct section as claimed in claim 6, wherein said outer casing comprises two or more outer casing panels configured to be joined together at respective longitudinal edges, and each of said outer casing panels having corresponding traverse edges.

8. The fire-rated duct section as claimed in claim 7, wherein said first duct connection section and said second duct connection section for said outer casing comprise a spacer section having a broken J-profile formed on each traverse edge of said outer casing panels.

9. The fire-rated duct section as claimed in claim 8, wherein said metallic material for said inner liner comprises a metallic material having a minimum thickness for a fire-rating according to one or more of an ASHRAE standard, according to the 2016 ASHRAE Handbook, HVAC Systems and Equipment, and a SMACNA HVACstandard, according to the HVAC Duct Construction Standards Metal and Flexible, 3rd Edition, 2005, and wherein said metallic material for said outer casing panels comprises a metallic material having a minimum thickness for a fire-rating according to one or more of the ASHRAE standard and the SMACNA HVAC standard.

10. The fire-rated duct section as claimed in claim 7, wherein said first duct connection section and said second duct connection section for said outer casing comprise a spacer section having a broken L-profile formed on each traverse edge of said outer casing panels.

11. The fire-rated duct section as claimed in claim 10, wherein said metallic material for said inner liner comprises a metallic material having a minimum thickness for a fire-rating according to one or more of an ASHRAE standard, according to the 2016 ASHRAE Handbook, HVAC Systems and Equipment, and a SMACNA HVAC standard, according to the HVAC Duct Construction Standards Metal and Flexible, 3rd Edition, 2005, and wherein said metallic material for said outer casing panels comprises a metallic material having a minimum thickness for a fire-rating according to one or more of the ASHRAE standard and the SMACNA HVAC standard.

12. The fire-rated duct section as claimed in claim 6, wherein said inner liner is formed from a continuous strip of metal spirally wound to form a continuous round tube.

13. The fire-rated ventilation duct section as claimed in claim 6, wherein said inner liner is formed from a continuous strip of metal spirally wound on a machine to form a continuous tube having one of said round cross-section profile or said oval cross-section profile.

* * * * *